US008292588B2

(12) United States Patent
Otsuki et al.

(10) Patent No.: US 8,292,588 B2
(45) Date of Patent: Oct. 23, 2012

(54) IMPELLER AND CENTRIFUGAL FAN

(75) Inventors: Takaya Otsuki, Kyoto (JP); Tatsuya Akase, Kyoto (JP); Tsunenori Tatsuno, Kyoto (JP); Toshikazu Fukunaga, Kyoto (JP); Kazumi Takeshita, Kyoto (JP); Tomohiko Ogasawara, Kyoto (JP)

(73) Assignee: Nidec Corporation, Kyoto (JP)

( * ) Notice: Subject to any disclaimer, the term of this patent is extended or adjusted under 35 U.S.C. 154(b) by 776 days.

(21) Appl. No.: 12/483,297

(22) Filed: Jun. 12, 2009

(65) Prior Publication Data

US 2009/0311093 A1 Dec. 17, 2009

(30) Foreign Application Priority Data

Jun. 14, 2008 (JP) ..... 2008-156055

(51) Int. Cl.
*F04D 29/30* (2006.01)

(52) U.S. Cl. ..... 416/195; 416/196 R; 416/203; 415/206

(58) Field of Classification Search ..... 416/195, 416/196 R, 169 A, 203, 228, 235, 238, 223 B, 416/234, 277 R; 415/206
See application file for complete search history.

(56) References Cited

U.S. PATENT DOCUMENTS 6,540,476 B2 4/2003 Huang et al.
6,736,610 B2 * 5/2004 Cifarelli ..... 417/366
6,877,954 B2 4/2005 Lin et al.
7,125,226 B2 10/2006 Horng et al.
7,207,779 B2 4/2007 Horng et al.
D575,749 S * 8/2008 Hwang et al. ..... D13/179
7,794,206 B2 * 9/2010 Keber et al. ..... 416/186 R
7,905,708 B2 * 3/2011 Fan et al. ..... 416/178
2004/0258527 A1 * 12/2004 Kaneko et al. ..... 416/182
2007/0014666 A1 * 1/2007 White ..... 416/179
2007/0098571 A1 * 5/2007 Nagamatsu ..... 417/354

FOREIGN PATENT DOCUMENTS

JP 2002-021782 A 1/2002

* cited by examiner

*Primary Examiner* — Ninh H Nguyen
(74) *Attorney, Agent, or Firm* — Keating & Bennett, LLP

(57) ABSTRACT

An impeller in a centrifugal fan includes a support portion having a cylindrical outer circumferential surface coaxial or substantially coaxial with a center axis and a plurality of moving blades arranged on the outer circumferential surface of the support portion independently of one another and configured to draw an air along the center axis and expel the air radially outwards when rotated about the center axis together with the support portion. At least one of the moving blades includes a first blade portion connected to, and extending radially outwards from, the outer circumferential surface of the support portion, at least one second blade portion having a radial inner end portion radially spaced apart from the outer circumferential surface of the support portion and a connecting member arranged to interconnect the first blade portion and the second blade portion.

17 Claims, 14 Drawing Sheets

IMPELLER AND CENTRIFUGAL FAN

BACKGROUND OF THE INVENTION

1. Field of Invention

The present invention relates to an impeller and a centrifugal fan.

2. Description of the Related Art

In recent years, electronic parts arranged within an electronic device tend to generate an increased amount of heat as the electronic devices achieve advanced performance. A centrifugal fan is often used in cooling the interior of the electronic device. In this case, the centrifugal fan is required to have an increased air-blowing ability in keeping with the increase in the amount of heat generated, while also assuring noise reduction.

In order to increase the air-blowing ability of the centrifugal fan, there is a need to enhance the static pressure and flow rate characteristics thereof. The number of moving blades needs to be increased for the accomplishment of high static pressure but needs to be decreased for the accomplishment of high flow rate. In other words, the static pressure and the flow rate are in a trade-off relationship with each other. This poses a problem in that improvement in one characteristic results in deterioration in the other.

The moving blades severely interfere with the axially flowing air stream in the vicinity of an intake port of the centrifugal fan. Because of this, the increase in the number of moving blades entails a further problem in that the noise is increased by the interference of the moving blades with the air stream near the intake port.

Japanese Patent Laid-open Publication No. 2002-21782 discloses a conventional centrifugal fan in which the number of moving blades is greater in the radial outer side than in the radial inner side, thus assuring increased intake efficiency and improved flow rate characteristics (see, for example, paragraph [0029] and FIGS. 17 and 18 of Japanese Patent Laid-open Publication No. 2002-21782).

In the centrifugal fan disclosed in Japanese Patent Laid-open Publication No. 2002-21782, fan blades and wing portions are interconnected at the radial outer sides of an impeller by an annular ring plate extending along the circumferential direction about the center axis of the impeller. Thus, the annular ring plate is apt to become an obstacle against the air stream generated by rotation of the impeller. This may result in a deteriorated flow rate characteristic, increased noise, and other problems.

SUMMARY OF THE INVENTION

In order to overcome the problems described above, preferred embodiments of the present invention provide an impeller and a centrifugal fan arranged to improve the static pressure and flow rate characteristics while enjoying a reduced amount of noise.

In accordance with a preferred embodiment of an impeller and a centrifugal fan, there is provided an impeller for use in a centrifugal fan including a support portion having a cylindrical outer circumferential surface coaxial or substantially coaxial with a center axis, and a plurality of moving blades arranged on the outer circumferential surface of the support portion independently of one another and configured to, when rotated about the center axis together with the support portion, draw in air along the center axis and radially expel the air outwards. At least one of the moving blades includes a first blade portion connected to, and extending radially outwards from, the outer circumferential surface of the support portion, at least one second blade portion having a radial inner end portion radially spaced apart from the outer circumferential surface of the support portion and a connecting member arranged to interconnect the first blade portion and the second blade portion.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
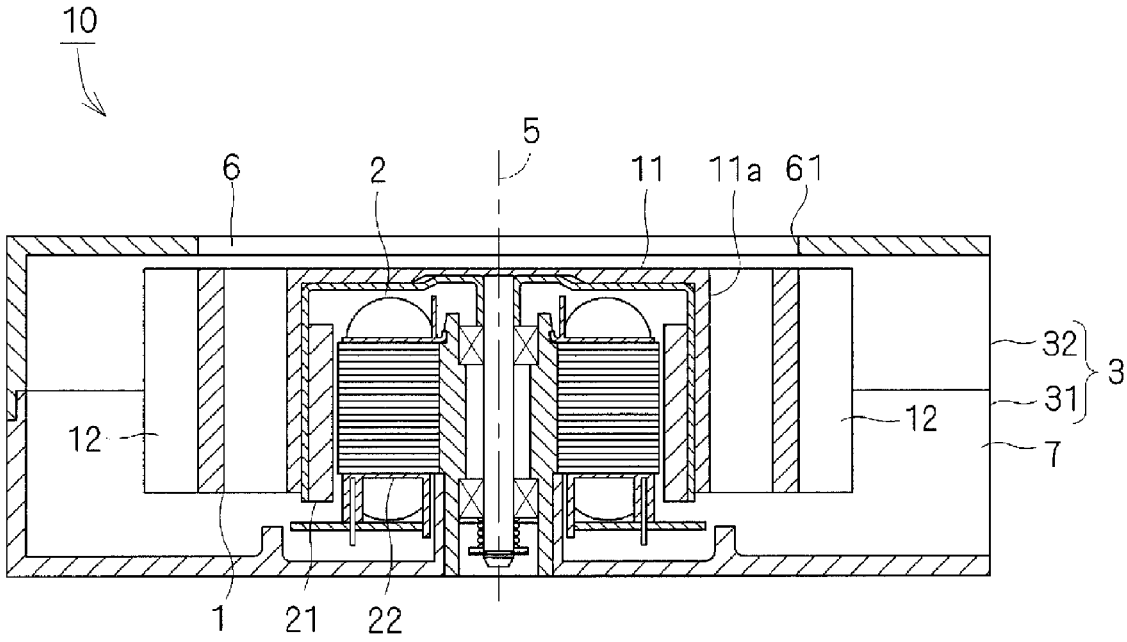
FIG. 1 is a section view showing a centrifugal fan incorporating an impeller in accordance with a preferred embodiment of the present invention.

Preferred embodiments of the present invention will be described in detail with reference to FIGS. 1 through 14. It should be noted that in the explanation of the preferred embodiments of the present invention, when positional relationships among and orientations of the different components are described as being up/down or left/right, ultimately positional relationships and orientations that are in the drawings are indicated; positional relationships among and orientations of the components once having been assembled into an actual device are not indicated. Meanwhile, in the following description, an axial direction indicates a direction parallel or substantially parallel to a center axis 5, and a radial direction indicates a direction perpendicular or substantially perpendicular to the center axis 5. In the preferred embodiments, the upper side along the center axis 5 refers to the upper side in FIG. 1, while the lower side along the center axis 5 refers to the lower side in FIG. 1.

Referring to FIG. 1, a centrifugal fan 10 in accordance with a preferred embodiment of the present invention preferably includes an impeller 1, a motor unit 2, and a casing 3. The cutaway position of the centrifugal fan 10 shown in FIG. 1 corresponds to the position indicated by line I-I in FIG. 3.

Figure 2:
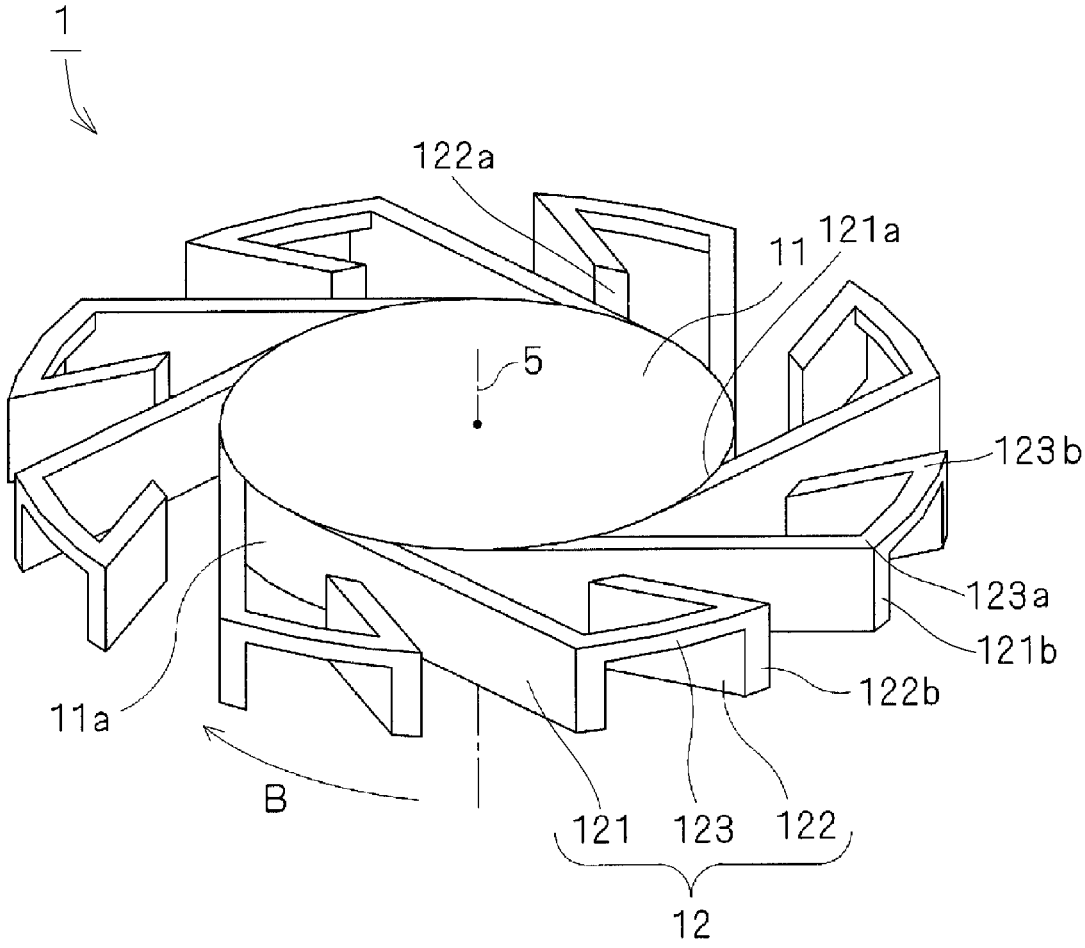
FIG. 2 is a top perspective view showing the impeller employed in the centrifugal fan shown in FIG. 1.
Figure 3:
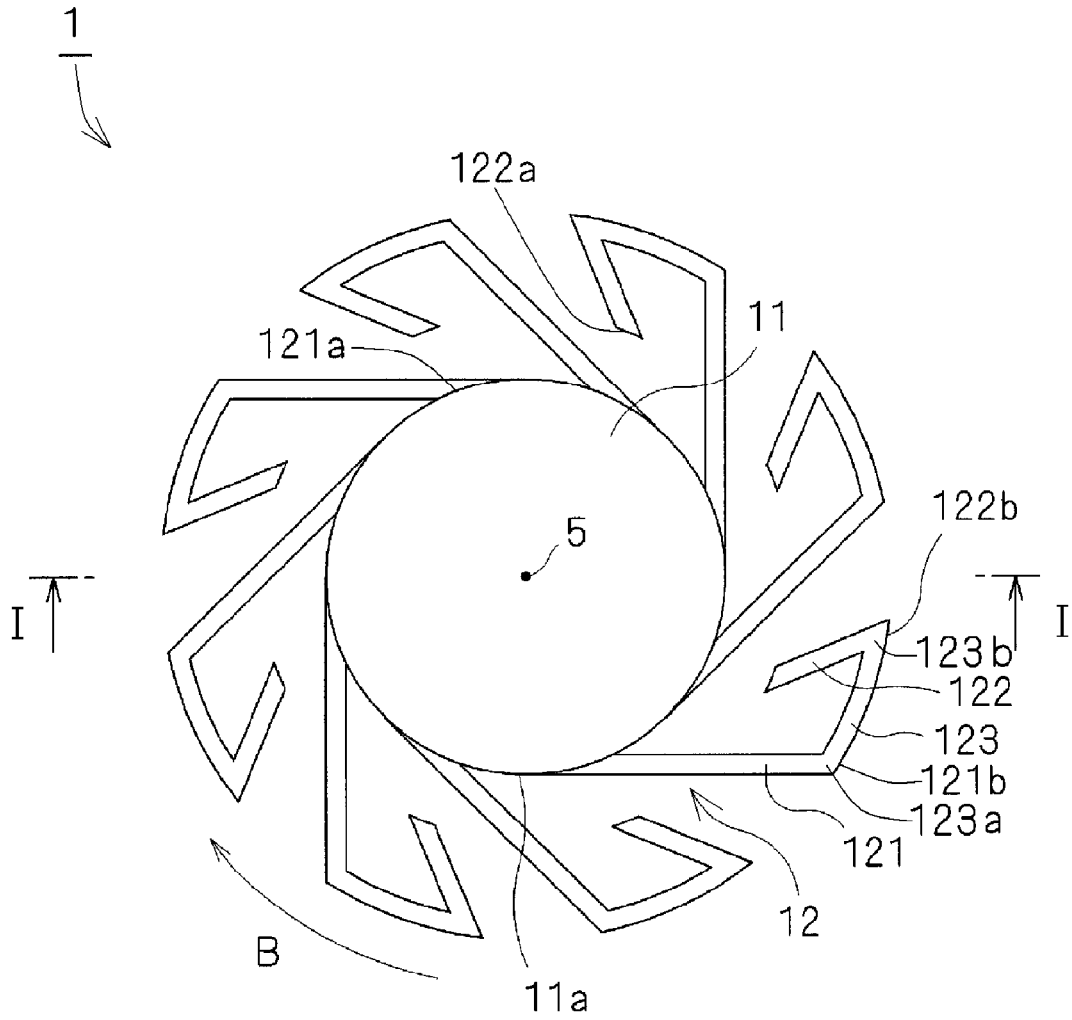
FIG. 3 is a top plan view of the impeller shown in FIG. 2.

As shown in FIGS. 1 through 3, the impeller 1 preferably includes a support portion 11 and a plurality of moving blades 12. In the present preferred embodiment, the impeller 1 is preferably molded into a single piece by, for example, injection-molding a resin or plastic (hereinafter simply referred to as a resin) material. However, the material of which the impeller 1 is made is not limited to the resin material. The impeller 1 may be made of other materials, e.g., a metallic material.

The support portion 11 includes a cylindrical outer circumferential surface 11*a* extending in a coaxial or substantially coaxial relationship with the center axis 5. More specifically, the support portion 11 may have, e.g., a bottom-closed cylindrical shape opened toward the lower side along the center axis 5 or a bottomless cylindrical shape opened toward the upper and lower sides along the center axis 5. In the present preferred embodiment, the support portion 11 has a bottom-closed cylindrical shape. The support portion 11 is configured to support the moving blades 12 while accommodating the motor unit 2 therein.

The moving blades 12, which are arranged independently of one another, extend radially outwards from the outer circumferential surface 11*a* of the support portion 11 and define backwardly oriented blades. The moving blades 12 rotate about the center axis 5 clockwise when seen from the upper side along the center axis 5 together with the support portion 11, thereby drawing in air along the center axis 5 and expelling the same radially outwards. As the moving blades 12 rotate, the air drawn through the below-mentioned intake port 6 of the casing 3 along the center axis 5 is caused to flow radially outwards and then discharged to the outside of the centrifugal fan 10 through the below-mentioned exhaust port 7 of the casing 3. The detailed configuration of the moving blades 12 will be described below.

The motor unit 2 preferably includes a rotor magnet 21 attached to the inner surface of the support portion 11 of the impeller 1 and an armature 22 arranged to generate a torque between itself and the rotor magnet 21. Thus, the motor unit 2 is arranged to rotate the impeller 1.

The casing 3 supports both the motor unit 2 and the impeller 1 to permit rotation about the center axis 5. In addition, the casing 3 accommodates the impeller 1 and is arranged to define a flow path of the air stream generated by rotation of the impeller 1. The casing 3 preferably has a substantially circular intake port 6 provided above the impeller 1 along the center axis 5 and an exhaust port 7 provided on the radially outer side of the casing 3. The intake port 6 is defined by a peripheral edge portion 61. The casing 3 preferably includes a casing body 31 and a cover 32. In the present preferred embodiment, although the intake port 6 is provided above the impeller 1 along the center axis 5, the present invention is not limited thereto. As an alternative example, the intake port 6 may be provided below the impeller 1 along the center axis 5 or both above and below the impeller 1 along the center axis 5.

Next, description will be made of the configuration of the moving blades 12 of the impeller 1. Referring to FIGS. 2 and 3, each of the moving blades 12 preferably includes a first blade portion 121, at least one second blade portion 122 (one in the present preferred embodiment), and a connecting member 123. The first blade portion 121 preferably has a radial inner end portion 121*a* connected to the outer circumferential surface 11*a* of the support portion 11 and extends radially outwards from the outer circumferential surface 11*a*. In contrast, the second blade portion 122 preferably has a radial inner end portion 122*a* radially spaced apart from the outer circumferential surface 11*a*. In the present preferred embodiment, the first and second blade portions 121 and 122 include radial outer end portions 121*b* and 122*b*, both of which are arranged substantially on the same perimeter of a circle coaxial with the center axis 5.

In the present preferred embodiment, the length of the first blade portion 121 along the center axis 5 is substantially the same as the length of the second blade portion 122 along the center axis 5. However, the present invention is not limited to such an arrangement, and the length of the first blade portion 121 may differ from that of the second blade portion 122.

The connecting member 123 is arranged to interconnect the first blade portion 121 and the second blade portion 122 and preferably has, e.g., a substantially rod-like shape. The first blade portion 121 supports the second blade portion 122 through the connecting member 123. When taken along an arbitrary plane containing the center axis 5, the connecting member 123 may have any cross-sectional shape so long as it has a low air resistance. Examples of the cross-sectional shape of the connecting member 123 include a circular shape and a streamline shape. The connecting member 123 is provided so that the entire portion thereof can be positioned radially outwards of the peripheral edge portion 61 that defines the intake port 6.

When the impeller 1 is seen from the upper side along the center axis 5, many different radial and circumferential arrangement methods can be used in interconnecting the first and second blade portions 121 and 122 with the connecting member 123. Certain modified examples of the impeller 1 embodying such arrangement methods will be described below.

In the present preferred embodiment, the radial outer end portion 122*b* of the second blade portion 122 is connected to the radial outer end portion 121*b* of the first blade portion 121 by the connecting member 123 as shown in FIGS. 2 and 3. Hereinafter, the portion in which the first blade portion 121 and the connecting member 123 are connected to each other will be referred to as a "first connection portion 123*a*" and the portion in which the second blade portion 122 and the connecting member 123 are connected to each other will be referred to as a "second connection portion 123*b*".

In the present preferred embodiment, the shortest distance from the center axis 5 to all the first connection portions 123*a* of the impeller 1 preferably remains the same. This holds true in all the second connection portions 123*b* of the impeller 1. In the present preferred embodiment, the connecting member 123 is arranged in such a way that a first imaginary circle joining the first connection portions 123*a* of the respective moving blades 12 overlaps with a second imaginary circle joining the second connection portions 123*b* of the respective moving blades 12. However, the present invention is not limited thereto. As an alternative example, the connecting member 123 may be arranged so that the second imaginary circle can lie radially outwards or inwards of the first imaginary circle.

In the present preferred embodiment, the shape of the connecting member 123 when seen from the upper side along the center axis 5 conforms to the perimeter of a circle coaxial or substantially coaxial with the center axis 5 and passing through the radial outer end portion 121*b* of the first blade portion 121 and the radial outer end portion 122*b* of the second blade portion 122. However, the present invention is not limited thereto. It may be possible to employ other shapes such as a straight shape and the like.

Figure 4:
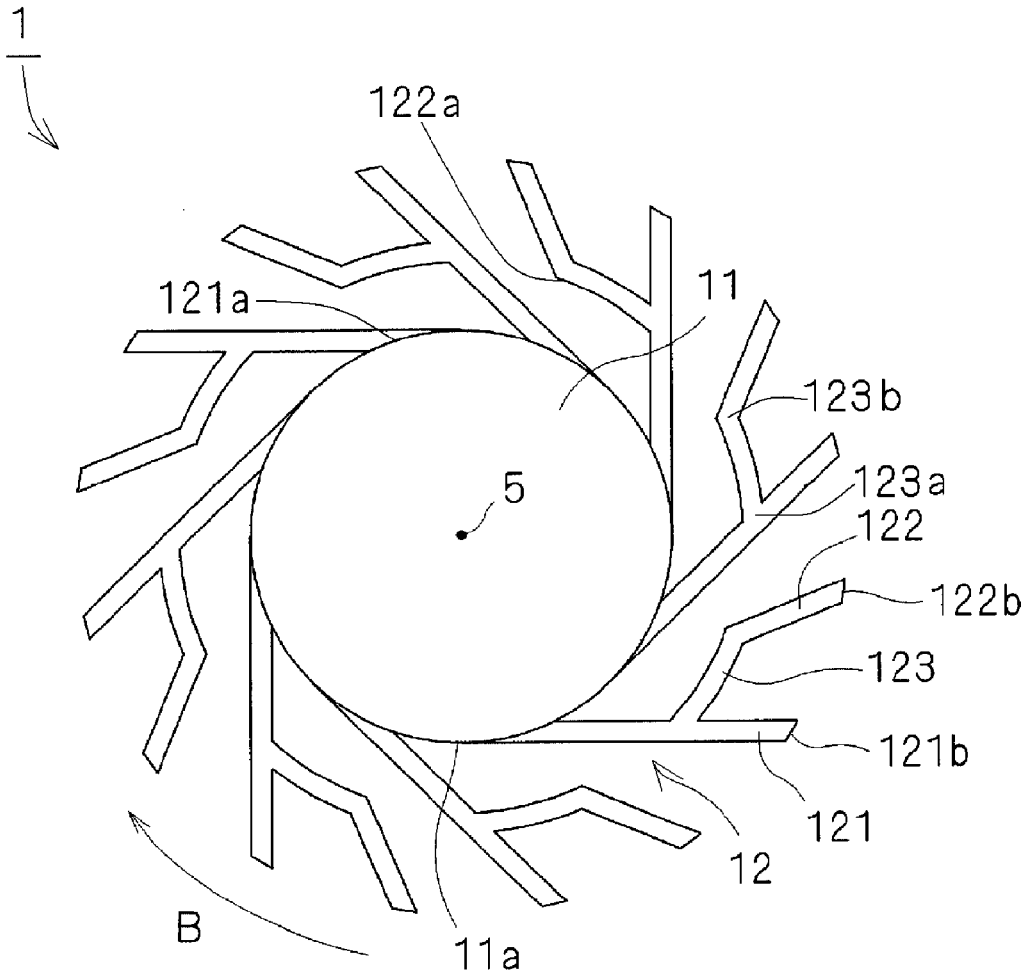
FIG. 4 is a top plan view showing a first modified example of the impeller shown in FIG. 2.

As shown in FIG. 4 which shows a first modified example of the impeller 1 relating to the radial position of the connecting member 123, the radial inner end portion 122*a* of the second blade portion 122 may be connected to a portion between the opposite radial end portions 121*a* and 121*b* of the first blade portion 121 (e.g., a radial center portion between the opposite radial end portions 121*a* and 121*b*) by the connecting member 123.

In this modified example, the shortest distance from the center axis 5 to all of the first connection portions 123*a* of the impeller 1 preferably remains the same. This holds true in all of the second connection portions 123*b* of the impeller 1. In this modified preferred embodiment, the connecting member 123 is preferably arranged in such a way that a first imaginary circle joining the first connection portions 123*a* of the respective moving blades 12 overlaps with a second imaginary circle joining the second connection portions 123*b* of the respective moving blades 12. However, the present invention is not limited thereto. As an alternative example, the connecting member 123 may be arranged so that the second imaginary circle can lie radially outwards or inwards of the first imaginary circle.

Figure 5:
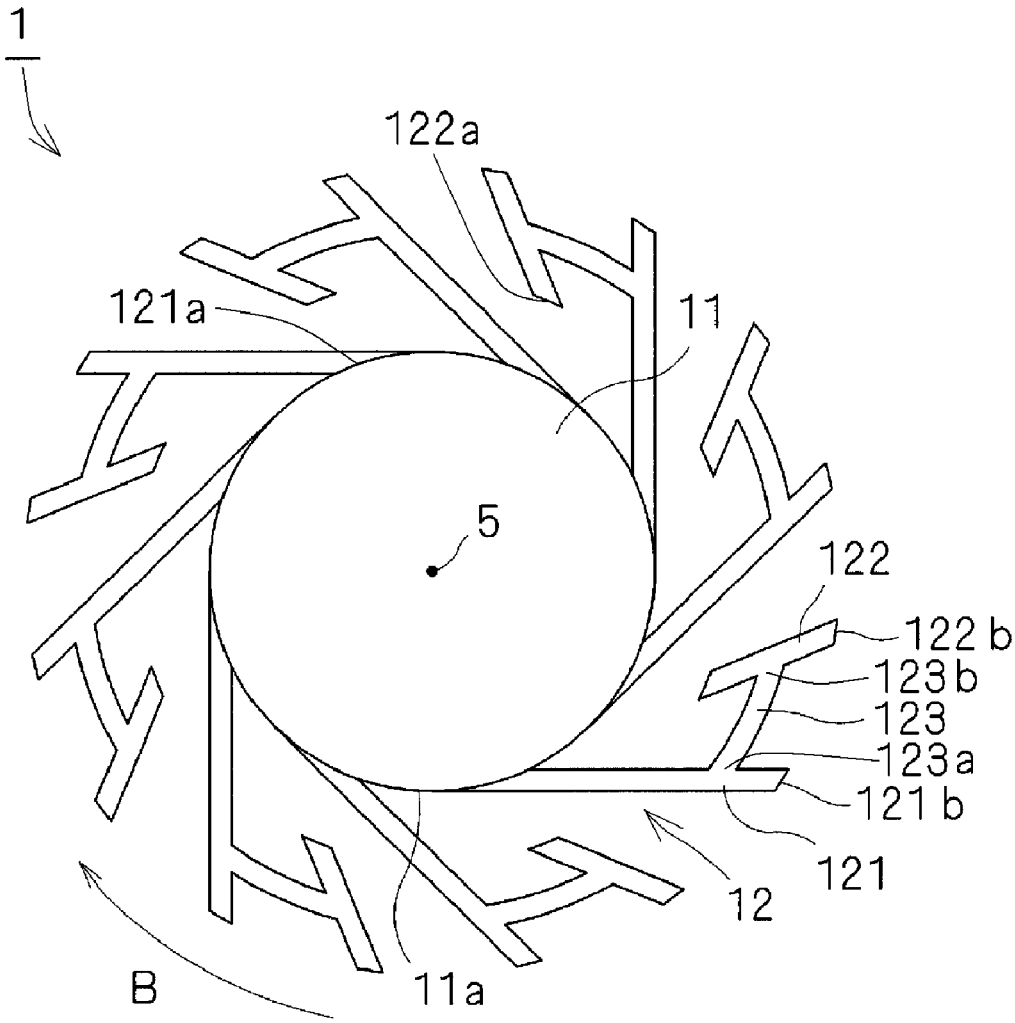
FIG. 5 is a top plan view showing a second modified example of the impeller shown in FIG. 2.

As shown in FIG. 5 which shows a second modified example of the impeller 1, a portion between the opposite radial end portions 121*a* and 121*b* of the first blade portion 121 may be connected to a portion between the opposite radial end portions 122*a* and 122*b* of the second blade portion 122 by the connecting member 123. In this modified example, the shortest distance from the center axis 5 to all of the first connection portions 123*a* of the impeller 1 preferably remains the same. This holds true in all of the second connection portions 123*b* of the impeller 1. In this modified example, the connecting member 123 is arranged in such a way that a first imaginary circle joining the first connection portions 123*a* of the respective moving blades 12 overlaps with a second imaginary circle joining the second connection portions 123*b* of the respective moving blades 12. However, the present invention is not limited thereto. As an alternative example, the connecting member 123 may be arranged so that the second imaginary circle can lie radially outwards or inwards of the first imaginary circle.

Although not shown in the drawings, the radial outer end portion 121*b* of the first blade portion 121 may be connected to the radial inner end portion 122*a* of the second blade portion 122 by the connecting member 123. As another alternative example, a portion between the opposite radial end portions 121*a* and 121*b* of the first blade portion 121 may be connected to the radial outer end portion 122*b* of the second blade portion 122 by the connecting member 123. As a further alternative example, a portion between the opposite radial end portions 122*a* and 122*b* of the second blade portion 122 may be connected to the radial outer end portion 121*b* of the first blade portion 121 by the connecting member 123.

The afore-mentioned modified examples of the impeller 1 regarding the radial position of the connecting member 123 may be employed in combination. For example, the impeller 1 may include two kinds of moving blades, namely first moving blades in which the radial outer end portion 122*b* of the second blade portion 122 is connected to the radial outer end portion 121*b* of the first blade portion 121 by the connecting member 123 and second moving blades in which the radial inner end portion 122*a* of the second blade portion 122 is connected to the first connection portion 123*a* which is a portion between the opposite radial end portions 121*a* and 121*b* of the first blade portion 121, by the connecting member 123.

When the impeller 1 is seen from the radial outer side, many different axial arrangement methods can be used in interconnecting the first and second blade portions 121 and 122 with the connecting member 123. Certain modified examples of the impeller 1 embodying such arrangement methods will be described below.

Figure 13:
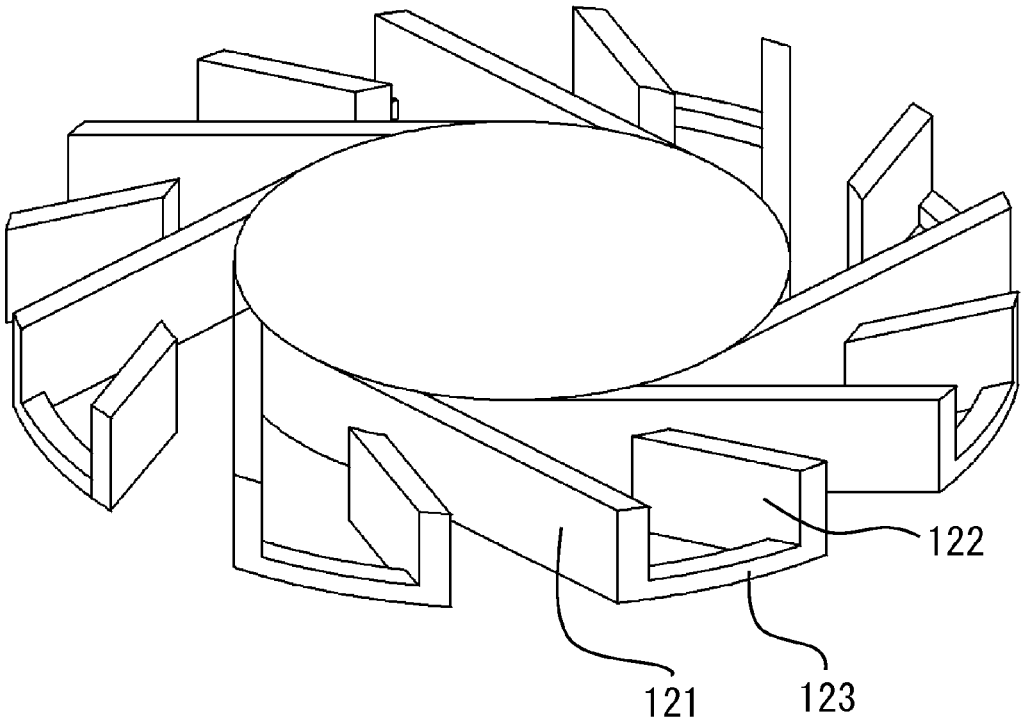
FIG. 13 is a top plan view showing a ninth modified example of the impeller shown in FIG. 2.

In the present preferred embodiment, as shown in FIG. 2, a portion of the axial upper edge of the first blade portion 121 is connected to a portion of the axial upper edge of the second blade portion 122 by the connecting member 123. As a modified example in this regard, a portion of the axial lower edge of the first blade portion 121 may be connected to a portion of the axial lower edge of the second blade portion 122 by the connecting member 123, as shown in FIG. 13.

As other modified examples, a portion of the axial upper edge of the first blade portion 121 may be connected to a portion of the axial lower edge of the second blade portion 122 by the connecting member 123. A portion of the axial lower edge of the first blade portion 121 may be connected to a portion of the axial upper edge of the second blade portion 122 by the connecting member 123.

Figure 12:
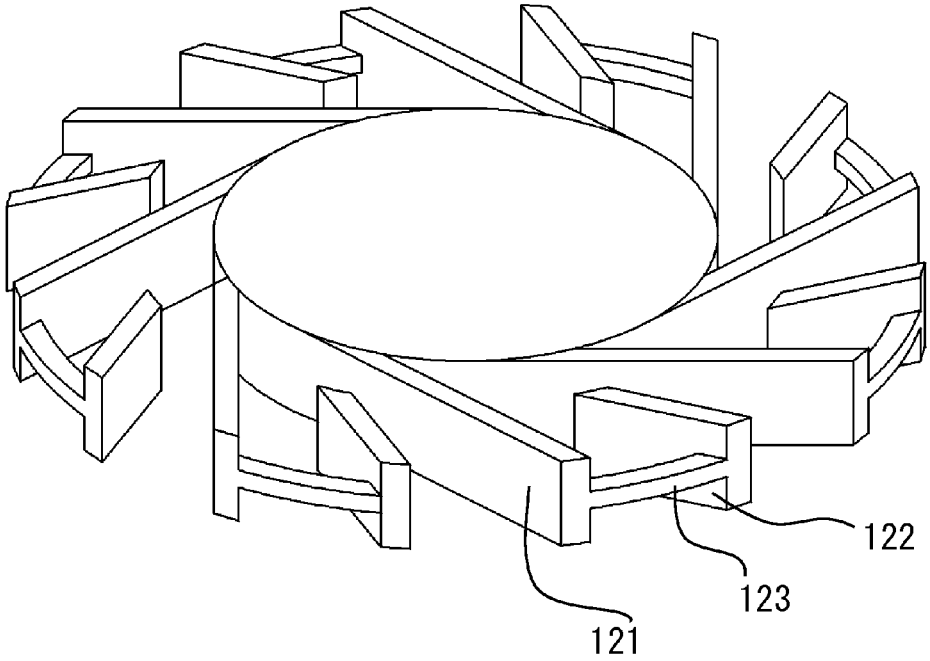
FIG. 12 is a top plan view showing a eighth modified example of the impeller shown in FIG. 2.

As a further alternative modified example, a portion between the axial upper and lower edges of the first blade portion 121 may be connected to a portion between the axial upper and lower edges of the second blade portion 122 by the connecting member 123, as shown in FIG. 12. For example, the middle portions between the axial upper and lower edges of the first and second blade portions 121 and 122 may be connected to each other. Alternatively, a portion of the axial upper or lower edge of the first blade portion 121 may be connected to a portion between the axial upper and lower edges of the second blade portion 122 by the connecting member 123. For example, a portion of the axial upper or lower edge of the first blade portion 121 may be connected to the middle portion between the axial upper and lower edges of the second blade portion 122 by the connecting member 123. Alternatively, a portion between the axial upper and lower edges of the first blade portion 121 may be connected to a portion of the axial upper or lower edge of the second blade portion 122 by the connecting member 123. For example, the middle portion between the axial upper and lower edges of the first blade portion 121 may be connected to a portion of the axial upper or lower edge of the second blade portion 122 by the connecting member 123.

The afore-mentioned modified examples of the impeller 1 regarding the axial position of the connecting member 123 may be employed in combination. For example, the impeller 1 may include two kinds of moving blades, namely first moving blades in which a portion of the axial upper edge of the first blade portion 121 is connected to a portion of the axial upper edge of the second blade portion 122 and second moving blades in which a portion of the axial lower edge of the first blade portion 121 is connected to a portion of the axial lower edge of the second blade portion 122.

Figure 6:
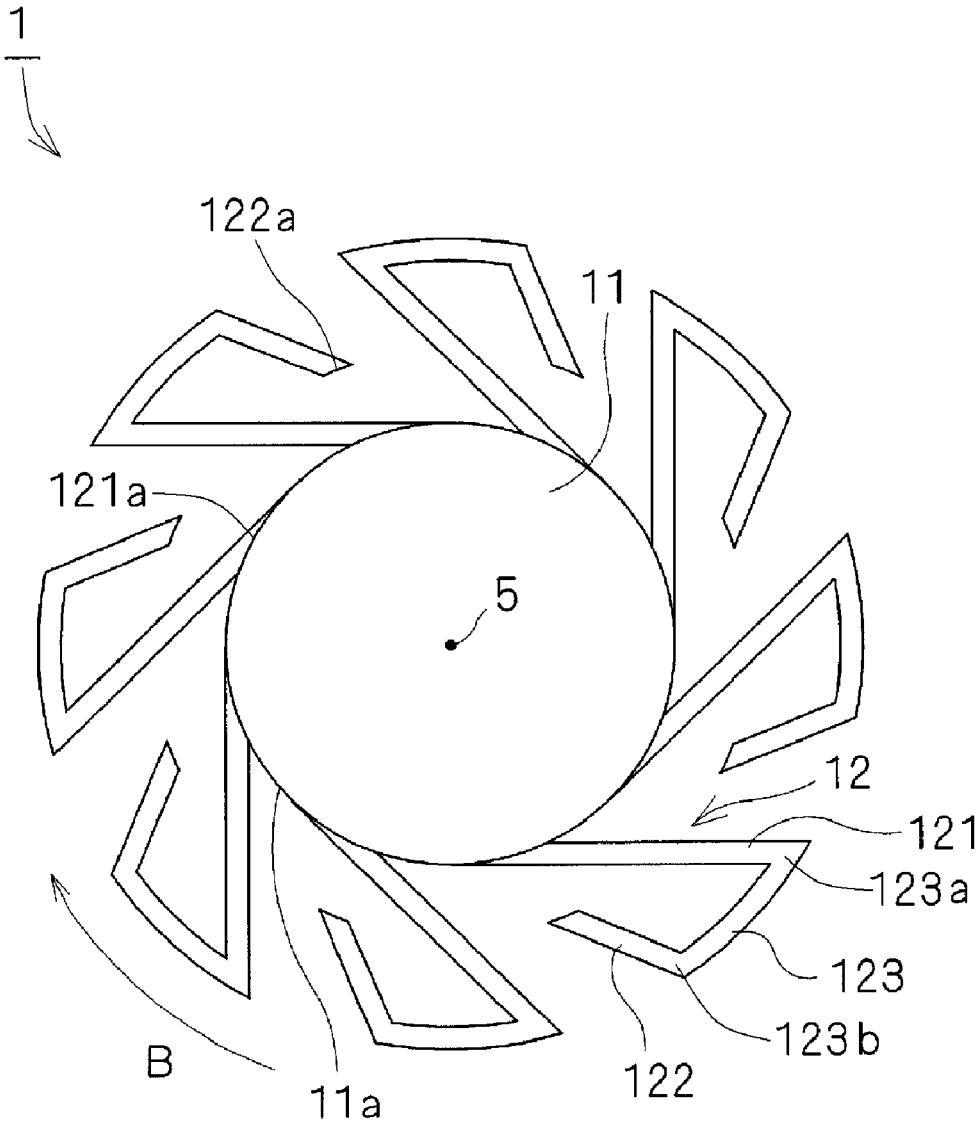
FIG. 6 is a top plan view showing a third modified example of the impeller shown in FIG. 2.
Figure 7:
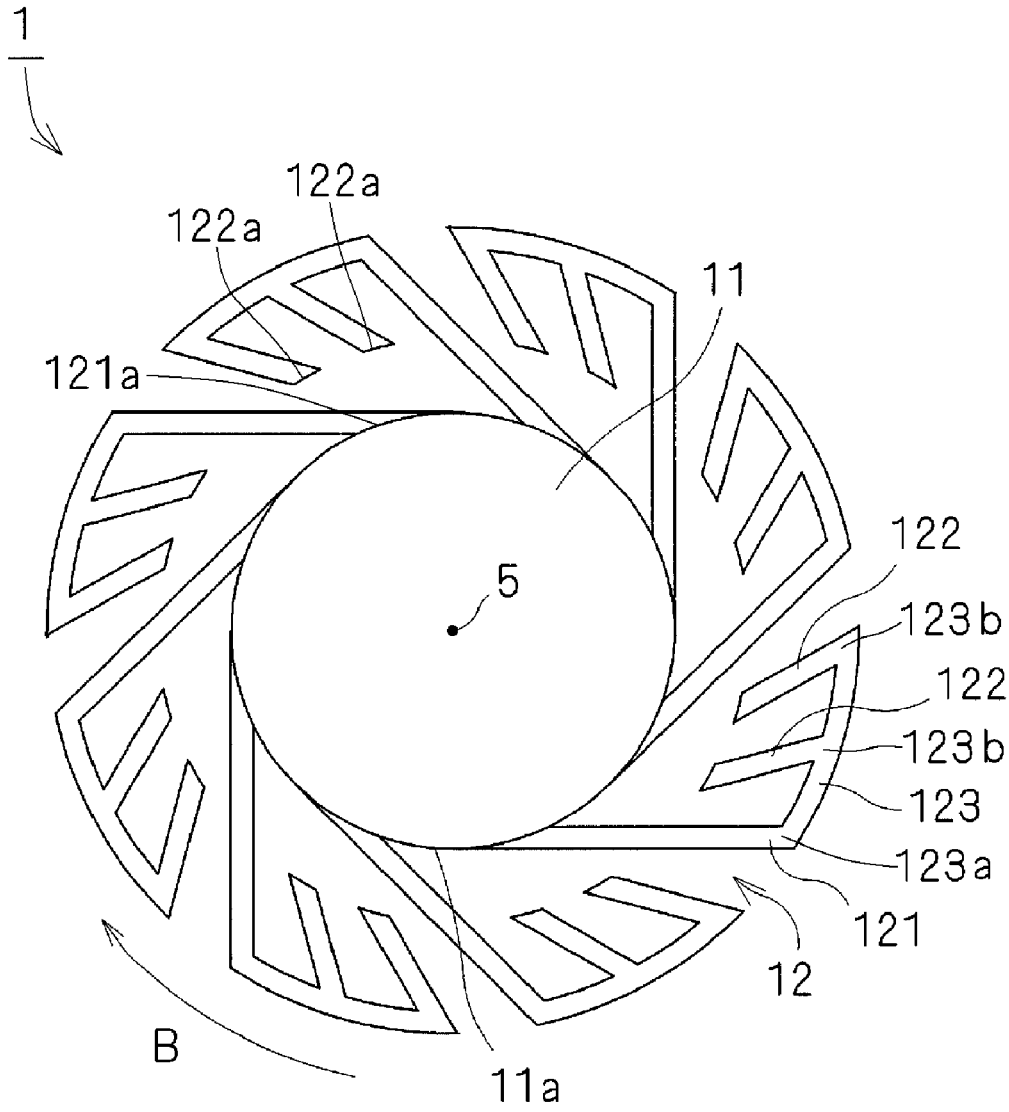
FIG. 7 is a top plan view showing a fourth modified example of the impeller shown in FIG. 2.
Figure 8:
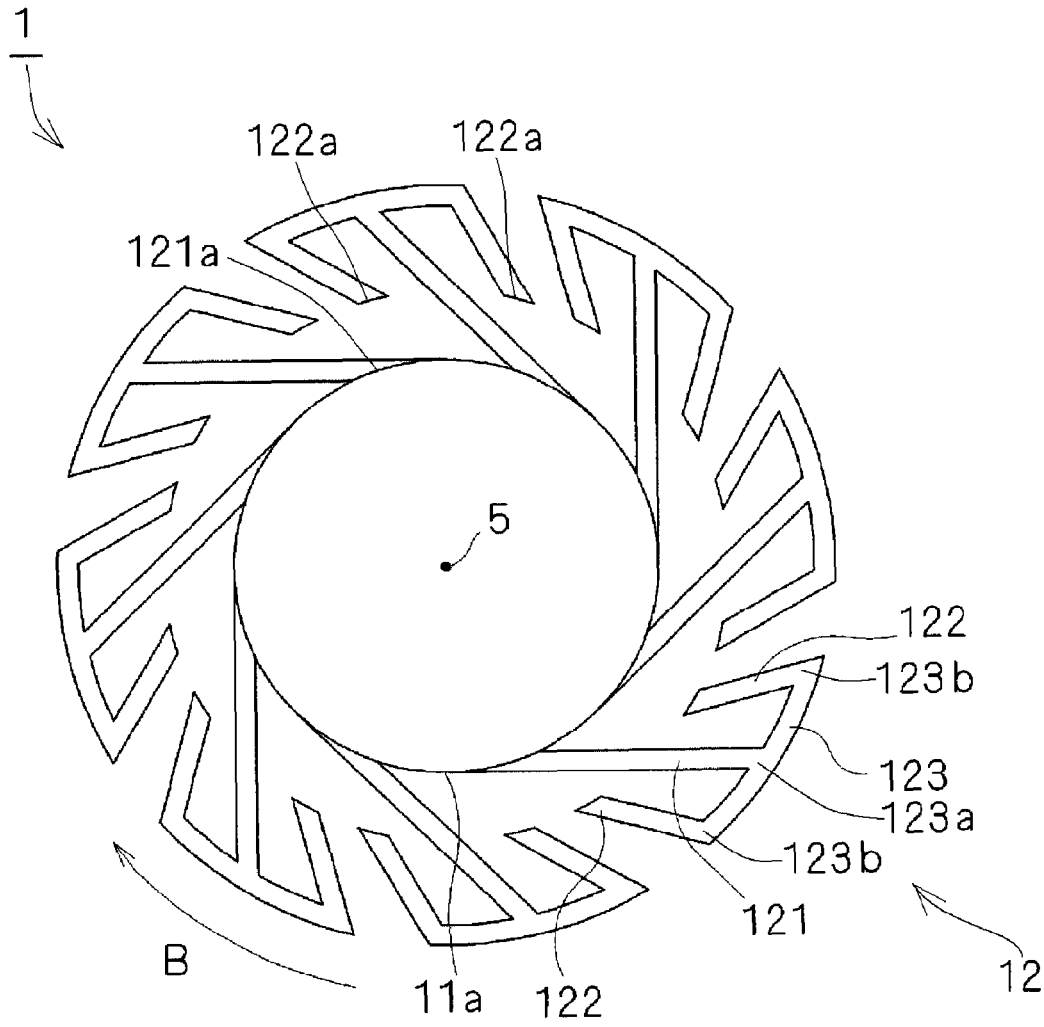
FIG. 8 is a top plan view showing a fifth modified example of the impeller shown in FIG. 2.

In the present preferred embodiment, as shown in FIGS. 2 and 3, the second blade portion 122 of each of the moving blades 12 is connected to the first blade portion 121 by the connecting member 123 extending from the first blade portion 121 in a direction opposite to the rotating direction B of the moving blades 12. As shown in FIG. 6 which shows a third modified example of the impeller 1, the second blade portion 122 may be connected to the first blade portion 121 by the connecting member 123 extending from the first blade portion 121 in the rotating direction B of the moving blades 12.

In the present preferred embodiment, as shown in FIGS. 2 and 3, each of the moving blades 12 preferably includes a single second blade portion 122. Alternatively, each of the moving blades 12 may include two or more second blade portions 122. Specific modified examples of the impeller 1 in this regard include the configurations shown in FIGS. 7 and 8. In a fourth modified example of the impeller 1 shown in FIG. 7, each of the moving blades 12 preferably includes at least two second blade portions 122 (two in the present modified example) provided in a circumferentially spaced-apart relationship in a direction opposite to the rotating direction B of the first blade portion 121. Although not shown in the drawings, two or more second blade portions 122 may preferably be provided in a circumferentially spaced-apart relationship in the same direction as the rotating direction B of the first blade portion 121. In a fifth modified example of the impeller 1 shown in FIG. 8, each of the moving blades 12 includes at least one second blade portion 122 (one in the present modified example) provided in the same direction as the rotating direction B of the first blade portion 121 and at least one second blade portion 122 (one in the present modified example) provided in the opposite direction to the rotating direction B of the first blade portion 121. As other modified examples, the number and arrangement position of the second blade portion 122 provided in each of the moving blades 12 may differ from blade to blade.

Figure 9:
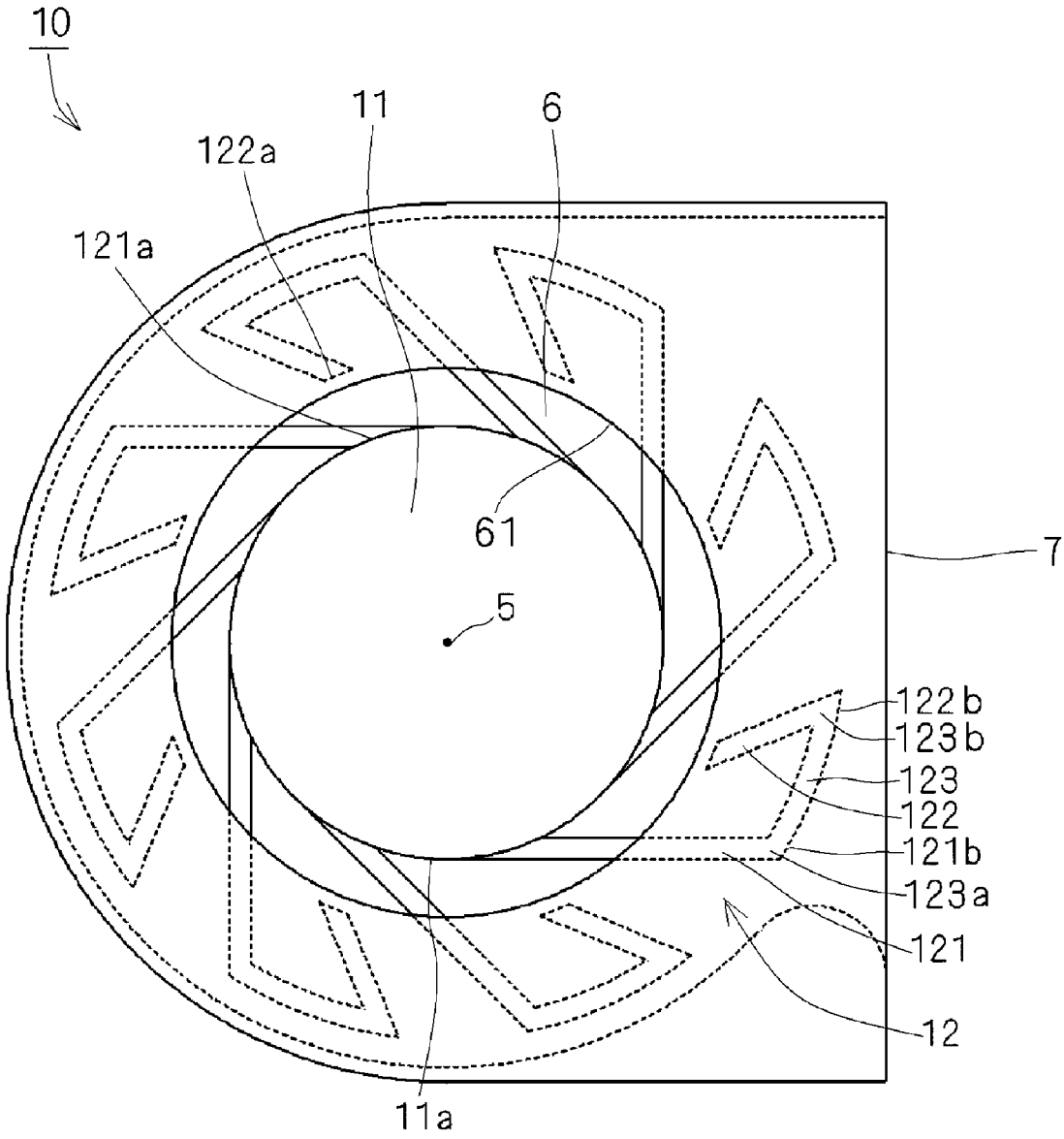
FIG. 9 is a top plan view of the centrifugal fan shown in FIG. 1.

In the present preferred embodiment, as shown in FIG. 9, the entirety of the connecting member 123 interconnecting the first blade portion 121 and the second blade portion 122 in each of the moving blades 12 is provided to lie radially outwards of the peripheral edge portion 61 defining the intake port 6. In other words, the entirety of the connecting member 123 is positioned radially outwards of the intake port 6.

In the present preferred embodiment, as shown in FIG. 9, the radial inner end portion 122*a* of the second blade portion 122 is provided to lie radially outwards of the peripheral edge portion 61 defining the intake port 6. In other words, the entirety of the second blade portion 122 is positioned radially outwards of the intake port 6.

As described above, each of the moving blades 12 of the impeller 1 includes the first blade portion 121 extending radially outwards from the cylindrical outer circumferential surface 11*a* of the support portion 11 and at least one second blade portion 122 (one in the present preferred embodiment) connected to the first blade portion 121 through the connecting member 123. The radial inner end portion 122*a* of the second blade portion 122 is arranged in a radially spaced-apart relationship with the outer circumferential surface 11*a* of the support portion 11. In the present preferred embodiment, the radial inner end portion 122*a* of the second blade portion 122 in each of the moving blades 12 is provided to lie radially outwards of the peripheral edge portion 61 defining the intake port 6. Therefore, when counting the number of blade portions of the moving blades 12 in the circumferential direction, the number of blade portions arranged in the radial outer region to mainly perform an exhaust function is greater than the number of blade portions arranged in the radial inner region to mainly perform an intake function.

This makes it possible to reduce the number of blade portions in the radial inner region, thereby diminishing the interference of an air stream with the blade portions. Consequently, it is possible to increase the air intake quantity and hence the air flow rate. The diminished interference of the air stream with the blade portions makes it possible to reduce the noise, the load of the motor unit 2 that rotates the impeller 1, and the electric power consumption. In the radial outer region, it is possible to maintain or increase the static pressure of the impeller 1 by securing a sufficient number of blade portions.

Furthermore, it is possible to reduce the noise and the electric power consumption of the fan by reducing the number of blade portions in the radial inner region. As a result, the revolution number of the impeller 1 can be increased in proportion to the reduction in the noise and the electric power consumption. This makes it possible to further improve the static pressure and flow rate characteristics of the impeller 1.

The respective moving blades 12 are arranged independently of one another to extend radially outwards from the outer circumferential surface 11*a* of the support portion 11. Thanks to this feature, the respective moving blades 12 are mutually spaced apart in the circumferential direction about the center axis 5 over the whole radial region. Objects impeding the air stream, such as a member arranged to interconnect the moving blades 12 and the like, preferably do not exist between the moving blades 12. This makes it possible to improve the flow rate characteristic of the impeller 1 and to reduce noise, as compared to the configuration disclosed in Japanese Patent Laid-open Publication No. 2002-21782 in which the centrifugal fan is provided with an annular ring plate. The reduction in noise also leads to reduced electric power consumption as mentioned above. As a result, the number of revolutions of the impeller 1 can be increased in proportion to the reduction in the noise and the electric power consumption. This makes it possible to further improve the static pressure and flow rate characteristics of the impeller 1.

In the present preferred embodiment, the entirety of the connecting member 123 is provided to lie radially outwards of the peripheral edge portion 61 defining the intake port 6. This makes it possible to prevent the air stream from interfering with the connecting member 123 when it is drawn through the intake port 6, which assists in increasing the flow rate and reducing the noise. The reduction in the noise leads to reduced electric power consumption as mentioned above. As a result, the number of revolutions of the impeller 1 can be increased in proportion to the reduction in the noise and the electric power consumption. This makes it possible to further improve the static pressure and flow rate characteristics of the impeller 1.

With the configurations of the various preferred embodiments and the afore-mentioned modified examples, it is therefore possible to provide the impeller 1 and the centrifugal fan 10 capable of reducing the noise while improving the static pressure and flow rate characteristics. In particular, with the configurations of the present preferred embodiment and the afore-mentioned modified examples, all the moving blades 12 include the first blade portion 121, at least one second blade portion 122, and the connecting member 123. This makes it possible to more effectively reduce the number of blade portions in the radial inner region while securing a sufficient number of blade portions in the radial outer region. As a consequence, it is possible to obtain a noise reduction effect and to further increase the number of revolutions of the impeller 1 as mentioned above. This makes it possible to more effectively improve the static pressure and flow rate characteristics of the impeller 1.

In the various preferred embodiments and the afore-mentioned modified examples, all the moving blades 12 of the impeller 1 are provided with the second blade portion 122 and the connecting member 123. However, the present invention is not limited thereto. Alternatively, only some of the moving blades 12 (at least one moving blade 12) may include the second blade portion 122 and the connecting member 123.

The impeller 1 disclosed herein may preferably be used in a small-size fan often used in, e.g., a notebook computer or the like. Therefore, it is less likely that the impeller structure described above may cause a problem in terms of strength and so forth. However, use of the impeller 1 is not strictly limited to the small-size fan, and the impeller 1 may be used in fans of varying sizes. For example, the impeller 1 may be used in big-size fans used in servers, communication devices and the like. No restriction is imposed on the use thereof.

In the various preferred embodiments and the afore-mentioned modified examples, the intake port 6 has a substantially circular shape. However, the shape of the intake port 6 is not limited thereto but may be polygonal, e.g., rectangular.

In the various preferred embodiments and the afore-mentioned modified examples, the entirety of the connecting member 123 is arranged to lie radially outwards of the peripheral edge portion 61 defining the intake port 6. However, the present invention is not limited thereto. At least a portion of the connecting member 123 may be positioned radially inwards of the peripheral edge portion 61.

Figure 14:
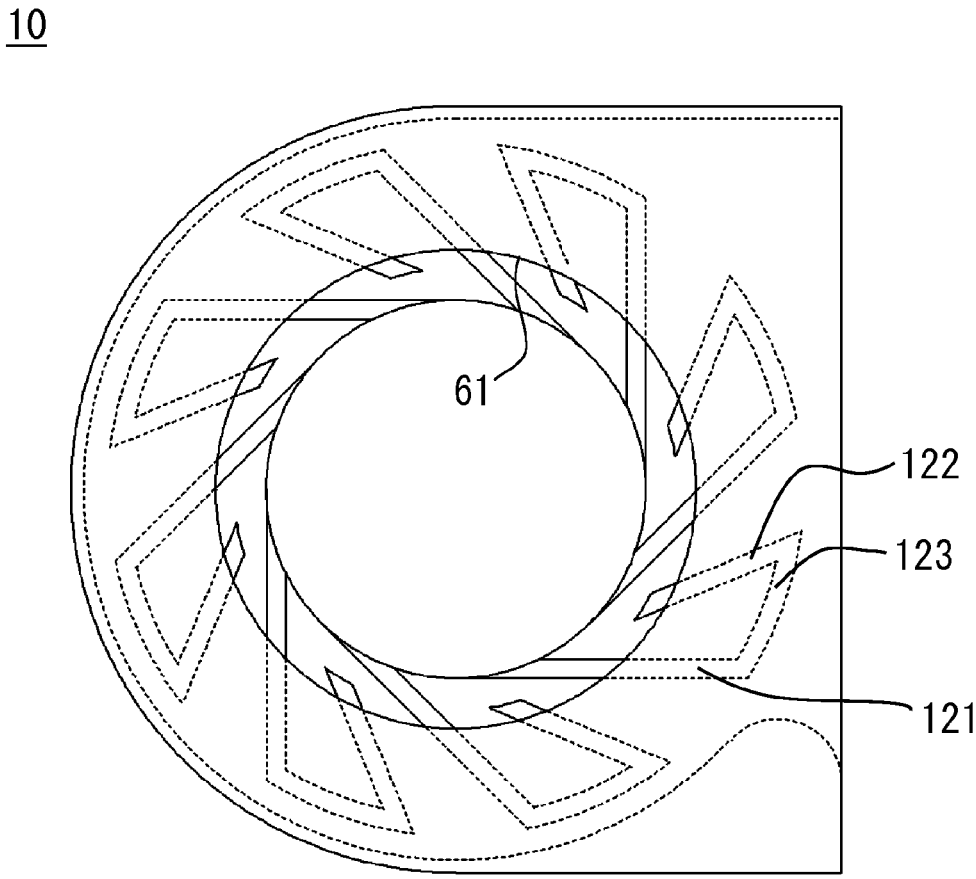
FIG. 14 is a top plan view showing a tenth modified example of the impeller shown in FIG. 2.

In the various preferred embodiments and the afore-mentioned modified examples, the radial inner end portions 122*a* of the second blade portions 122 are arranged to lie radially outwards of the peripheral edge portion 61 defining the intake port 6. However, the present invention is not limited thereto. At least a portion of the radial inner end portions 122*a* may be positioned radially inwards of the peripheral edge portion 61, as shown in FIG. 14.

Figure 10:
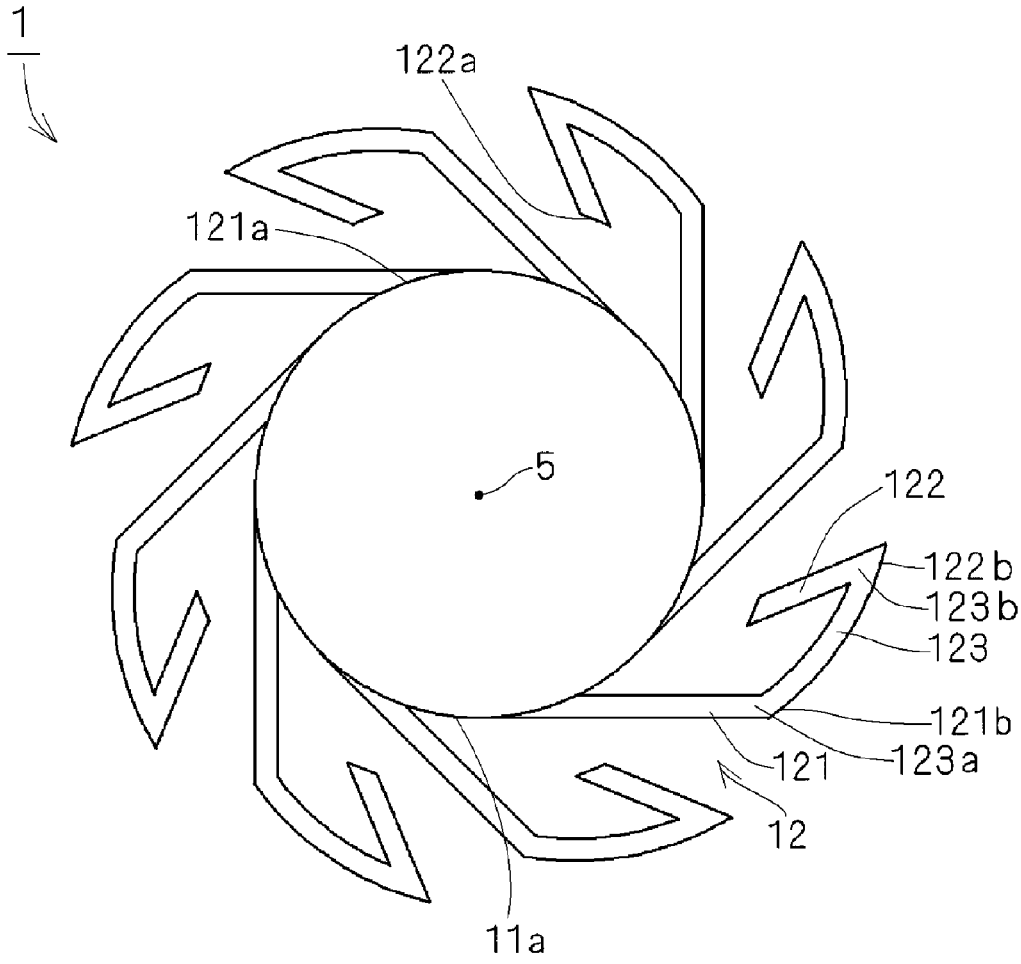
FIG. 10 is a top plan view showing a sixth modified example of the impeller shown in FIG. 2.
Figure 11:
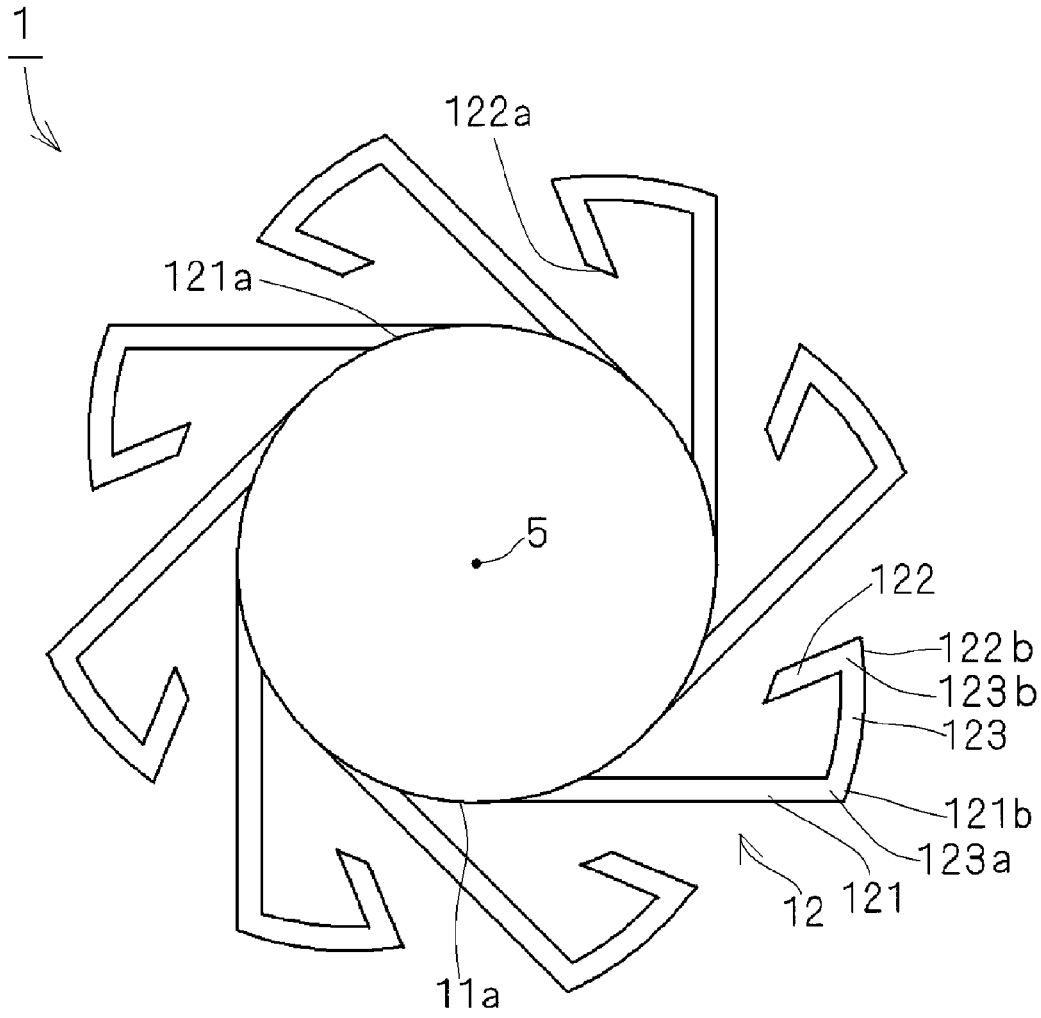
FIG. 11 is a top plan view showing a seventh modified example of the impeller shown in FIG. 2.

In the various preferred embodiments and the afore-mentioned modified examples, the radial outer end portions 121*b* of the first blade portions 121 and the radial outer end portions 122*b* of the second blade portions 122 are arranged on the same perimeter of a circle coaxial or substantially coaxial with the center axis 5. However, they may not be arranged on the same perimeter. For example, as shown in FIG. 10 which shows a sixth modified example of the impeller 1, the radial outer end portions 122*b* of the second blade portions 122 may be positioned radially outwards of the imaginary circle which is coaxial or substantially coaxial with the center axis 5 and joins the radial outer end portions 121*b* of the first blade portions 121 of the respective moving blades 12. Furthermore, as shown in FIG. 11 which shows a seventh modified example of the impeller 1, the radial outer end portions 122*b* of the second blade portions 122 may be positioned radially inwards of the imaginary circle which is coaxial or substantially coaxial with the center axis 5 and joins the radial outer end portions 121*b* of the first blade portions 121 of the respective moving blades 12. The different axial and radial arrangements of the connecting member 123 described above can apply to the connecting member 123 of the sixth and seventh modified examples. Furthermore, the connecting member 123 preferably has a substantially flat shape such that a height of the axial upper edge thereof in the axial direction is the same or substantially the same as a height of the axial upper edge of the first blade portions 121 or a height of the axial upper edge of the second blade portions 122 in the axial direction.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An impeller for use in a centrifugal fan, the impeller comprising:

a support portion including a cylindrical outer circumferential surface coaxial or substantially coaxial with a center axis; and a plurality of blades independently arranged on the outer circumferential surface of the support portion and configured to draw in air along the center axis and expel the air radially outwards when rotated about the center axis together with the support portion; wherein at least two of the plurality of blades each include:

a first blade portion connected to, and extending radially outwards from, the outer circumferential surface of the support portion, and at least one second blade portion including a radial inner end portion radially spaced apart from the outer circumferential surface of the support portion; and a connecting member arranged to connect the first blade portion and the at least one second blade portion; and each of the at least two of the plurality of blades is arranged such that the first blade portions are connected to only respective ones of the at least one second blade portions through only respective ones of the connecting members.

2. The impeller of claim 1, wherein all of the plurality of blades include the first blade portion, the at least one second blade portion, and the connecting member.

3. The impeller of claim 1, wherein a radial outer end portion of the first blade portion and a radial outer end portion of the at least one second blade portion are arranged on a common perimeter of a circle coaxial or substantially coaxial with the center axis.

4. The impeller of claim 1, wherein the connecting member is arranged to connect a radial outer end portion of the first blade portion and a radial outer end portion of the at least one second blade portion.

5. The impeller of claim 1, wherein the connecting member is arranged to connect a portion between radial inner and outer end portions of the first blade portion and the radial inner end portion of the at least one second blade portion.

6. The impeller of claim 1, wherein the connecting member is arranged to connect a portion between radial inner and outer end portions of the first blade portion and a portion between the radial inner end portion and a radial outer end portion of the at least one second blade portion.

7. The impeller of claim 1, wherein the connecting member is arranged to connect an axial upper end portion of the first blade portion and an axial upper end portion of the at least one second blade portion.

8. The impeller of claim 1, wherein the connecting member is arranged to connect an axial lower end portion of the first blade portion and an axial lower end portion of the at least one second blade portion.

9. The impeller of claim 1, wherein the connecting member is arranged to connect a portion between axial upper and lower end portions of the first blade portion and a portion between axial upper and lower end portions of the at least one second blade portion.

10. The impeller of claim 1, wherein the impeller is a unitary molded resin piece.

11. A centrifugal fan comprising:

the impeller of claim 1;

a motor unit arranged to rotate the impeller; and a casing arranged to support the motor unit and to accommodate the impeller, the casing including:

an intake port arranged on at least one of an axial upper side and an axial lower side of the impeller;

a peripheral edge portion defining the intake port; and an exhaust port arranged on a radial outer side of the impeller.

12. The centrifugal fan of claim 11, wherein the connecting member is positioned radially outwardly of the peripheral edge portion defining the intake port.

13. The centrifugal fan of claim 11, wherein an entirety of the connecting member is positioned radially outwardly of the peripheral edge portion defining the intake port.

14. The centrifugal fan of claim 11, wherein at least a portion the connecting member is positioned radially inwardly of the peripheral edge portion defining the intake port.

15. The centrifugal fan of claim 11, wherein the radial inner end portion of the at least one second blade portion is positioned radially outwardly of the peripheral edge portion defining the intake port.

16. The centrifugal fan of claim 11, wherein an entirety of the at least one second blade portion is positioned radially outwardly of the peripheral edge portion defining the intake port.

17. The centrifugal fan of claim 11, wherein the radial inner end portion of the at least one second blade portion is positioned radially inwardly of the peripheral edge portion defining the intake port.

* * * * *